US006651756B1

(12) United States Patent
Costo, Jr. et al.

(10) Patent No.: US 6,651,756 B1
(45) Date of Patent: Nov. 25, 2003

(54) STEEL BODY DRILL BITS WITH TAILORED HARDFACING STRUCTURAL ELEMENTS

(75) Inventors: Robert J. Costo, Jr., The Woodlands, TX (US); James L. Overstreet, Tomball, TX (US); Anton F. Zahradnik, Sugarland, TX (US); James L. Duggan, Friendswood, TX (US); Russel S. Smith, Conroe, TX (US); Mark E. Morris, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 42 days.

(21) Appl. No.: 09/715,406

(22) Filed: Nov. 17, 2000

(51) Int. Cl.[7] ..... E21B 10/46

(52) U.S. Cl. ..... 175/374; 175/431; 76/108.2

(58) Field of Search ..... 175/374, 406, 175/429, 431; 76/108.2

(56) References Cited

U.S. PATENT DOCUMENTS

| | | | | |
|---|---|---|---|---|
| 3,800,891 | A | | 4/1974 | White et al. |
| 4,006,788 | A | | 2/1977 | Garner |
| 4,277,108 | A | | 7/1981 | Wallace |
| 4,455,278 | A | * | 6/1984 | van Nederveen et al. |
| 4,499,958 | A | | 2/1985 | Radtke et al. |
| 4,726,432 | A | | 2/1988 | Scott et al. |
| 4,814,234 | A | * | 3/1989 | Bird ..... 175/375 |
| 4,884,477 | A | | 12/1989 | Smith et al. |
| 5,051,112 | A | | 9/1991 | Keshavan et al. |
| 5,291,807 | A | | 3/1994 | Vanderford et al. |
| 5,431,239 | A | | 7/1995 | Tibbitts et al. |
| 5,492,186 | A | | 2/1996 | Overstreet et al. |
| 5,516,053 | A | | 5/1996 | Hannu |
| 5,582,258 | A | * | 12/1996 | Tibbitts et al. |
| 5,663,512 | A | | 9/1997 | Schader et al. |
| 5,758,733 | A | * | 6/1998 | Scott et al. |
| 5,921,330 | A | * | 7/1999 | Sue et al. |
| 5,924,502 | A | | 7/1999 | Arfele et al. |
| 5,979,576 | A | | 11/1999 | Hansen et al. |
| 6,045,750 | A | | 4/2000 | Drake et al. |

FOREIGN PATENT DOCUMENTS

| | | | |
|---|---|---|---|
| EP | 0569663 A1 | * | 11/1993 |
| GB | 2 125 466 A | | 3/1984 |
| GB | 2 147 033 A | | 5/1985 |
| GB | 2 190 024 A | | 11/1987 |
| WO | WO 00/43628 | | 7/2000 |

OTHER PUBLICATIONS

Search Report of Sep. 10, 2002.
UK Search Report dated Jan. 31, 2002.

* cited by examiner

*Primary Examiner*—David Bagnell
*Assistant Examiner*—Daniel P Stephenson
(74) *Attorney, Agent, or Firm*—TraskBritt

(57) ABSTRACT

Hardfacing is deposited on a PDC-equipped steel body rotary drag bit and forms substantially protruding structural elements, such as wear knots or chip breakers. Hardfacing may also be applied to features such as gage pads, wherein at least two different hardfacing compositions are utilized and specifically located in order to exploit the material characteristics of each type of hardfacing composition employed. The use of multiple hardfacing compositions may further be employed as a wear-resistant coating on various elements of the drill bit. The surfaces to which hardfacing is applied may include machined slots, cavities or grooves providing increased surface area for application of the hardfacing. Additionally, such surface features may serve to effect a desired residual stress state in the resultant hardfacing layer or other structure.

22 Claims, 9 Drawing Sheets

STEEL BODY DRILL BITS WITH TAILORED HARDFACING STRUCTURAL ELEMENTS

BACKGROUND OF THE INVENTION

1. Field of the Invention

The present invention relates generally to rotary bits for drilling subterranean formations. More specifically, the invention relates to fixed cutter or so-called "drag" bits which are fabricated from steel, known as steel body bits, employing superabrasive cutters and tailored structural elements substantially fabricated from hardfacing materials.

2. State of the Art

Hardfacing has been used in the downhole tool art for some time as a way to increase the erosion and abrasion resistance of certain areas of roller cone bits and steel body bits. Relatively thin layers of hardfacing have been applied to relatively large areas where erosion and abrasion from cuttings, high-velocity fluid and contact with the formation causes undesirable wear on the bit. Steel bits, such as roller cone bits, exhibit much more erosive and abrasive wear than so-called matrix bits which are manufactured by infiltration of molten metal into a matrix material comprising tungsten carbide or other powder. Many fixed cutter drill bits are manufactured from tungsten carbide matrix, as well as from steel. Steel body bits tend to exhibit superior toughness but limited erosion and abrasion resistance, whereas matrix bits tend to exhibit reduced toughness but exemplary erosion and abrasion resistance.

Hardfacing is generally composed of some form of hard particles delivered to a surface via a welding delivery system. Hardfacing refers to the deposited material rather than the constituent materials which make up the hardfacing. Constituent materials of hardfacing are referred to as a hardfacing composition. Hard particles may come from the following group of cast or sintered carbides consisting of chromium, molybdenum, niobium, tantalum, titanium, tungsten, and vanadium and alloys and mixtures thereof, as disclosed by U.S. Pat. No. 5,663,512 to Schader et al., assigned to the assignee of the present invention and incorporated by reference herein. Commonly, a mixture of sintered, macrocrystalline, or cast tungsten carbides is captured within a mild steel tube. The steel tube containing the carbide mixture is then used as a welding rod to deposit hardfacing onto the desired surface, usually with a deoxidizer, or flux.

The shape, size, and relative percentage of different hard particles will affect the wear and toughness properties of the deposited hardfacing, as described by Schader et al. U.S. Pat. No. 5,492,186 to Overstreet, assigned to the assignee of the present invention and incorporated by reference herein, describes a hardfacing configuration for heel row teeth on a roller cone drill bit. The coating comprises two hardfacing compositions tailored for different properties. A first hardfacing composition may be characterized by good sliding wear resistance and/or abrasion resistance with a lower level of toughness. The second hardfacing composition contains carbide particles of spherical sintered, crushed sintered and cast tungsten carbide. A substantial portion of the particles in the second composition are characterized by a higher level of fracture resistance, or toughness, and a lower level of abrasion resistance.

Hardfacing compositions have been also used for coating the gage surfaces of roller cone teeth, as disclosed in U.S. Pat. No. 3,800,891 to White et al. White also discloses, with respect to the hardfacing of teeth on a milled steel tooth rolling cone-type bit, circumferential grooves and a transverse slot on each roller cone tooth for the deposition of hardfacing.

Hardfacing has been utilized with steel body bits in certain circumstances. For example, U.S. Pat. No. 4,499,958 to Radtke et al. discloses hardfacing on the blades and other portions of the bit subject to abrasive wear. However, use of hardfacing material as taught by Radtke et al. does not address issue of material toughness as may be required for various portions of the bit while also exploiting the advantages of an abrasion-resistant material.

So-called matrix bits, aforementioned for their superior abrasion and erosion resistance, have also been contemplated as benefitting from hardfacing as well. U.S. Pat. No. 4,884,477 to Smith et al., assigned to the assignee of the present invention, discloses a metal matrix bit body composed of a filler material of higher toughness than tungsten carbide with substantially all of the internal and external surfaces of the bit body coated with an erosion- and abrasion-resistant hardfacing comprised of tungsten carbide or silicon carbide. However, Smith et al. does not address strategic localization of a material according to its characteristics of either abrasion resistance or material toughness. Smith et al. fails to particularly address such issues with regard to a steel body bit.

Additionally, while many efforts have been directed at utilizing and improving hardfacing and its application to drill bits, multiple hardfacing compositions have not been used to enhance or form structural elements on steel body drill bits. For example, structural elements of a steel body drill bit which substantially protrude from the surface of the drill bit, such as wear knots or chip breakers, have not previously benefitted from the use of hardfacing materials.

Wear knots may serve to limit the depth of cut of cutting structure on a drill bit during operation and thereby protect the cutting structure from damage. Wear knots for steel body drill bits may be conventionally formed by press fitting a sintered tungsten carbide stud into a hole milled into the bit body. Alternatively, a wear knot may be machined into the bit body, although this requires a predetermination of the placement of the wear knot and may limit the design topography of the drill bit.

Chip breakers serve to influence the formation of chips which are initiated at the leading edges of cutters and are pushed along the surface of a blade of the bit carrying the cutters such that they are weakened and subsequently broken into smaller elements during the drilling process. Such a chip breaker is described in greater detail in U.S. Pat. No. 5,582,258 to Tibbitts et al., assigned to the assignee of the present invention and incorporated by reference herein. Chip breakers form a "bump" in the surface of the blade and in the direct path of the formation of the chip which causes the chip to break before becoming overly elongated. This breakage prevents chips from building up along the surface of the bit and possibly balling the bit with an agglomeration of chips, as is known in the art. Chip breakers in steel body bits may be machined into the surface of the bit; however, this too may place limits on the bit design.

Gage elements for steel body bits are typically formed by drilling holes into the gage surface and pressing sintered tungsten carbide cylinders into the holes. As an additional measure, a layer of hardfacing may be applied around the sintered carbide cylinders, on the body of the bit, but the cylinders function as the main elements to prevent abrasion and wear on the gage, and are designed and configured to maximize the exposed area of the sintered cylinders to the borehole sidewall. Although sintered carbide cylinders function adequately as a drill bit gage, the necessity of milling precise holes for press fitting is cumbersome and limits the configuration of the gage. In addition, sintered carbide gage cylinders often exhibit cracking after use, referred to as crazing, perhaps attributable to the extreme heating and cooling cycles present during drilling conditions.

In view of the shortcomings in the art, it would be advantageous to provide a steel body drag-type bit employing structurally protruding elements formed of hardfacing materials. It would further be advantageous to provide hardfacing in a drill bit wherein such hardfacing was localized according to the material properties of the hardfacing material. Such localization could be employed to include hardfacing of multiple material compositions exploiting advantageous material properties of each individual composition.

It would also be advantageous to provide a method of modifying existing bits to employ structurally protruding elements formed of a hardfacing material. Such a method would allow for the simpler and more cost-efficient manufacture of such bits while still allowing for application-specific customization of such bits.

It would also be advantageous to provide a bit, as well as a method of manufacturing such a bit, exhibiting a tailored surface with respect to the manner in which hardfacing is applied such that a desirable stress state is imparted to the resultant hardfacing structure. It would be advantageous to employ hardfacing having such a resultant stress state designed according to the expected loading or stress imparted to the bit while in operation.

BRIEF SUMMARY OF THE INVENTION

The inventors herein have recognized that structural elements of a steel body drill bit may be formed by application of hardfacing. Modifying surface geometry of the surface receiving the hardfacing and modifying hardfacing compositions are techniques of tailoring the structural elements according to the present invention.

Specifically, according to one aspect of the invention, a gage is formed by applying one composition of hardfacing to rotationally leading and trailing edges of the gage pad and filling in between these edges on the radially outer surface of the gage pad with a second different hardfacing composition. This allows for tailoring of the hardfacing properties for each respective area. By way of example, if the edges are expected to experience an increased amount of chipping, the hardfacing composition in that area may be tailored with respect to toughness. In the area between the edges, where cracking may be less of a concern, the hardfacing composition may be tailored with respect to wear characteristics.

Another aspect of using multiple hardfacing compositions in different places along the bit applies to the use of hardfacing as a protective coating. As such, multiple materials may be used to coat the outer surfaces of the drill bit to hinder erosion and abrasion. For example, where more erosion-resistant materials are needed, a hardfacing with a relatively large amount of macrocrystalline tungsten carbide may be used. Similarly, for example, where hardfacing with increased toughness is desired, spherical sintered and cast tungsten carbide may be used. In the degenerate case, the entire surface of applied hardfacing on the steel body drill bit would be tailored, area by area, with desired characteristics. More practically, selected areas would be tailored for desired hardfacing characteristics as needed.

In accordance with yet another aspect of the invention, a gage is defined by forming grooves in a gage pad of a steel bit body and subsequently filling the grooves with a hardfacing composition. The grooves are believed to reduce chipping of the hardfacing during drilling of a subterranean formation. Also, the grooves provide an increased amount of surface area for attaching the hardfacing to the bit body as well as an increased volume of hardfacing. Hardfacing compositions may be varied as well, as described in the first embodiment, where a first hardfacing is used on rotationally leading and trailing edges and a second hardfacing is used in between the two rotational edges on the radial outer surface of the gage pad. In a further combination, grooves may be located in various regions along the surface of the gage.

Carried further, the grooves may be oriented and tailored for loading and residual stress considerations. Orienting the grooves generally along the longitudinal axis of the blade is one configuration; however, it may be beneficial to orient the grooves with respect to loading characteristics of the blade. In addition, it is contemplated that a beneficial stress-relieved state in the hardfacing may be achieved by modifying the surface of the gage to which hardfacing is applied via at least one groove. This stress state will manifest as a result of thermal expansion differences between the bit body material and the hardfacing upon affixing the hardfacing to the bit at a high temperature. Compressive stress states are generally preferable for brittle materials; however, tensile stress states may be advantageous as well. Overlapping grooves, grooves with different depths, concentric grooves, V-shaped grooves, U-shaped grooves, or otherwise configured or combined groove geometries may be used to achieve a desired result.

The present invention also contemplates forming wear knots or chip breakers on a steel body bit. Several advantages are apparent from this method. For example, a bit may be manufactured without wear knots or chip breakers initially, and then, if wear knots or chip breakers are desired, the bit may be subsequently configured with wear knots or chip breakers fabricated from a hardfacing material. This expands the suitability of one bit for multiple applications. Also, in the case of a worn bit, modifications and repairs to the wear knots or chip breakers are easily made when provided from hardfacing materials, as opposed to conventional techniques of creating these structures.

Stated another way, the present invention encompasses and includes the overall concept of providing protruding hardfacing structures on steel body bits such as wear knots and chip breakers, as well as gage pads and protective coatings formed from at least two different hardfacing compositions. Additionally, the invention encompasses and includes steel body drill bit surfaces comprising at least one groove for accepting hardfacing.

DETAILED DESCRIPTION OF THE PREFERRED EMBODIMENTS

Figure 1:
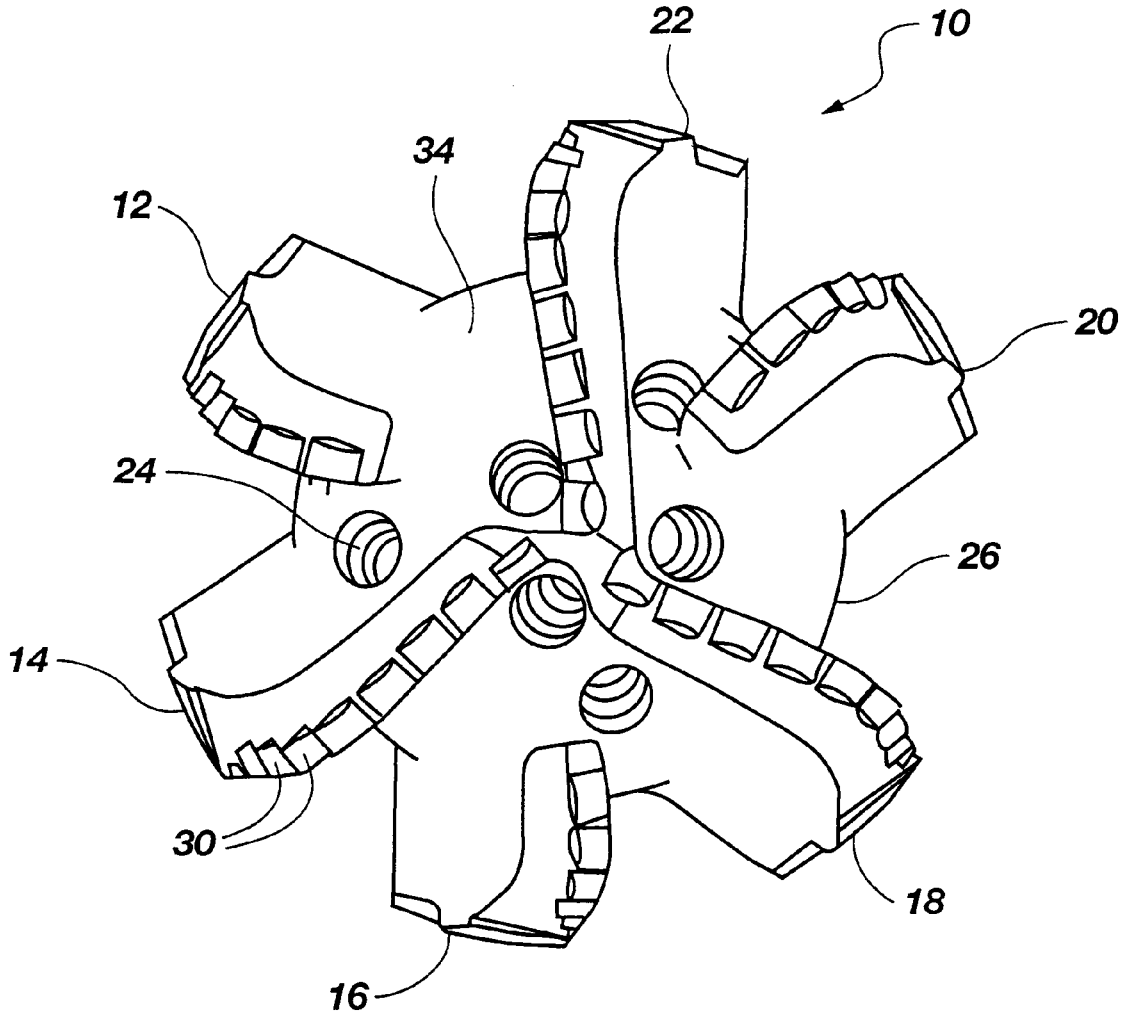
FIG. 1 depicts a top elevation of a steel body drill bit without cutters or gage structures.
Figure 2:
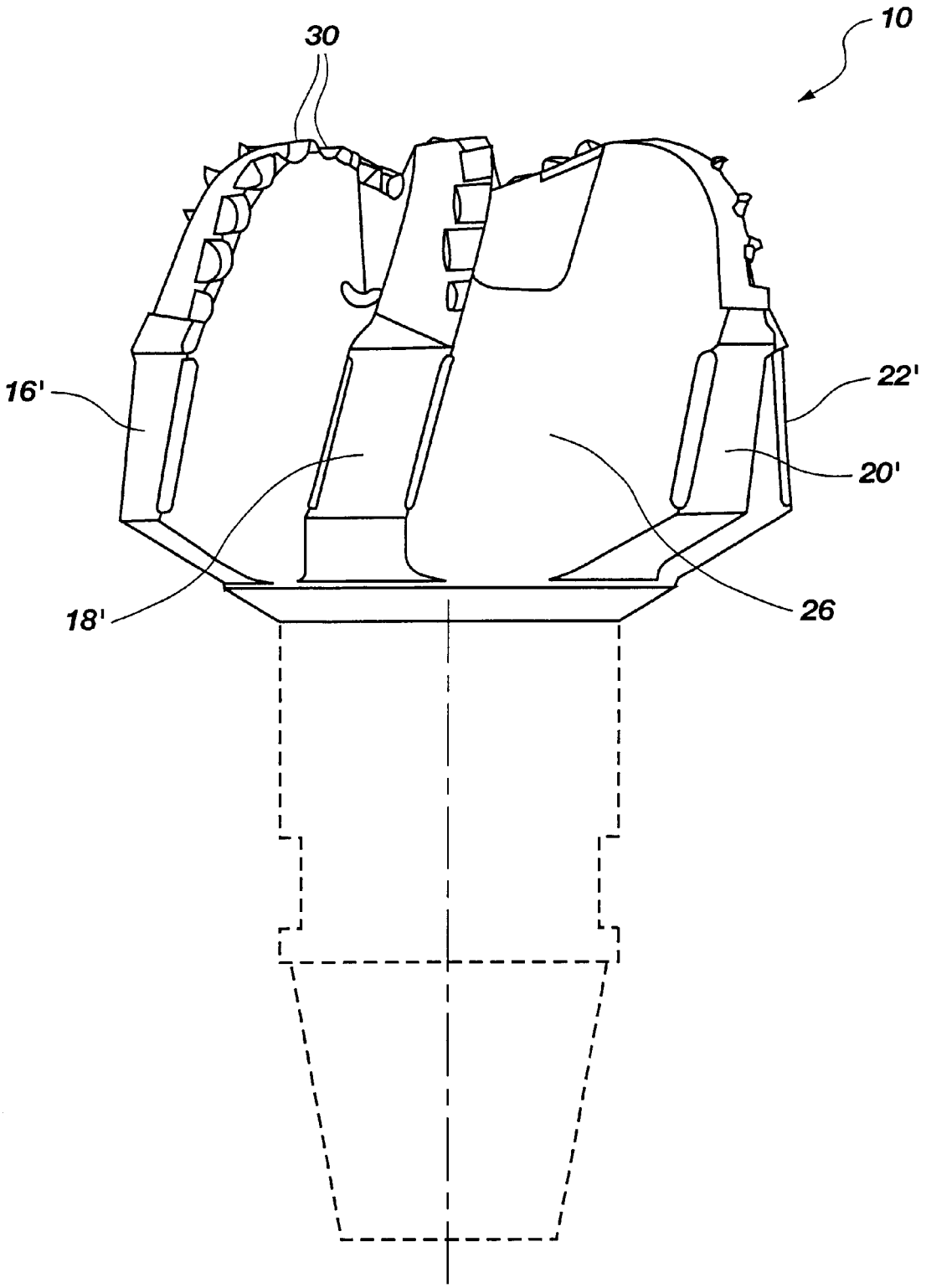
FIG. 2 depicts a side elevation of the steel body drill bit in FIG. 1.
Figure 4:
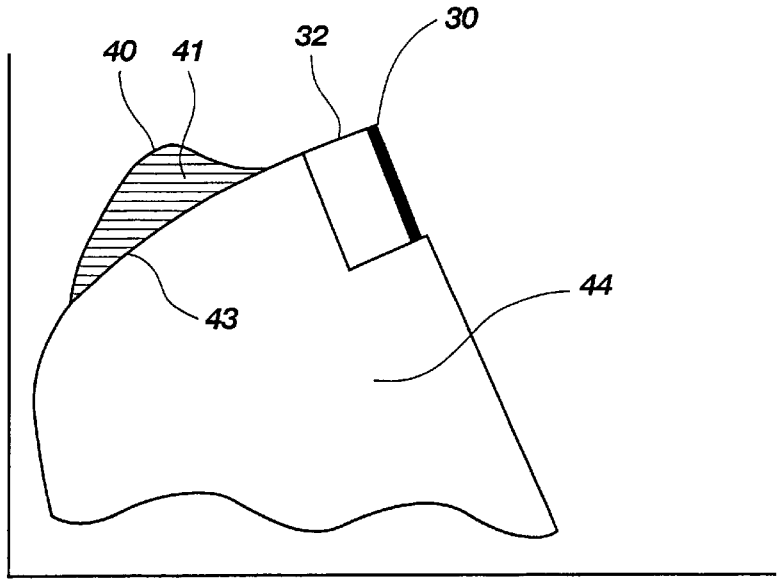
FIG. 4 depicts a side cross-sectional view of a bit blade configured with a wear knot of the present invention.

FIG. 1 shows an exemplary steel body drill bit 10 configured with blades 12, 14, 16, 18, 20, and 22 extending generally radially and longitudinally from drill bit 10. Drill bit 10 may be formed by casting, machining, welding, forging, broaching, or any combination of methods or other known methods for producing steel body bits. Cutter pockets are generally designated by numeral 30 and are configured on the blades 12–22 for accepting superabrasive cutters 32 (FIG. 4). Bit face 34 contains apertures 24 for communicating drilling fluid through the steel body drill bit 10 through nozzles (not shown) placed in apertures 24, as is known in the art. Turning to FIG. 2, junk slot area 26 shown in both FIG. 1 and FIG. 2 allows for the passage of cuttings generated by cutters 32 and carried by drilling fluid. FIG. 2 also shows the gage areas of bit blades 16, 18, 20, or 22 designated by 16', 18', 20', and 22', respectively, where hardfacing may be deposited to create a gage pad. Additionally, the threaded bit shank for coupling the steel body drill bit 10 to a drill string has been shown in broken lines for greater clarity and context of the invention.

Figure 3:
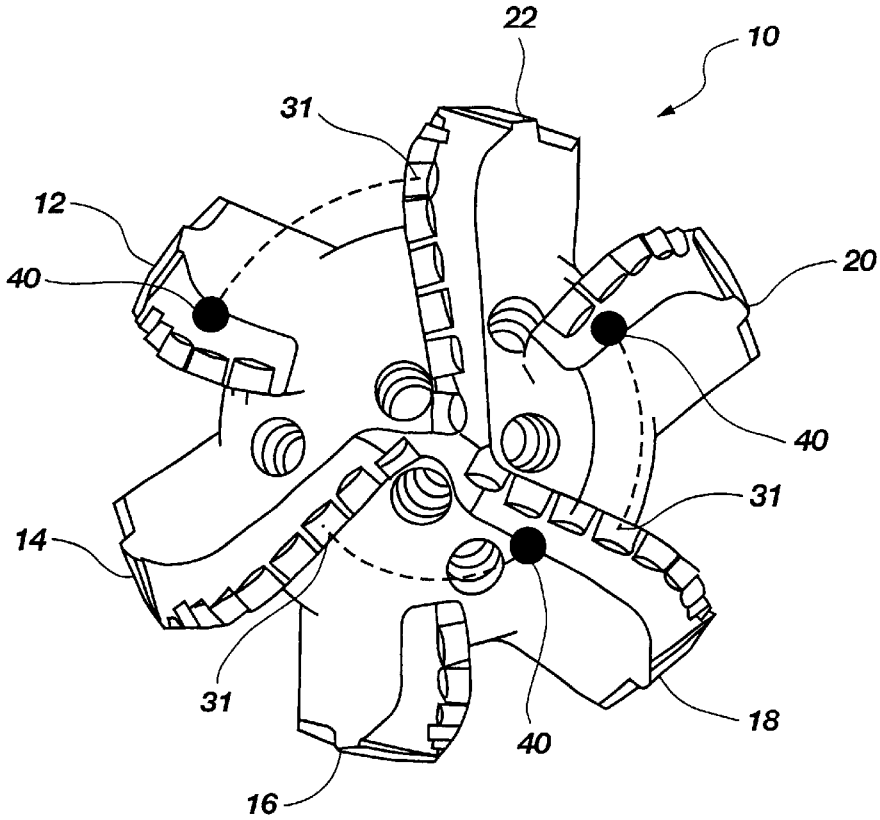
FIG. 3 depicts placement of wear knots on a top elevation of the steel body drill bit in FIG. 1 of the present invention.

Referring now to FIG. 3, several possible locations for wear knots 40 on blades 12, 18, and 20 are indicated. However, locations for wear knots are not limited to blades depicted with wear knots in FIG. 3. Wear knots 40 may be located on any blade 12, 14, 16, 18, 20, and 22 in multiple locations thereon. Wear knots 40 as shown are radially associated with selected cutter pockets 31, shown by a dotted line. The wear knots 40 are designed to extend to a level just above the kerf that is cut by the rotationally following cutter as the steel body drill bit 10 is rotated against a formation. Thus, the wear knot 40 precedes its respective cutter pocket 31. If the rate of penetration during drilling of the steel body drill bit 10 increases above the desired level, wear knots 40 will contact the formation, limiting the depth of cut on the cutters 32 and thereby preventing possible damage.

FIG. 4 shows a side cross section of the wear knot 40 of the present invention positioned on a blade 44. Also shown is a cutter pocket 30 as well as a superabrasive cutter 32 as known in the art. Hardfacing 41 is deposited generally onto the top surface 43 of the blade 44 to form a structure which protrudes therefrom. Hardfacing 41 may be deposited as known in the art and then modified as desired or required via machining or grinding to achieve the desired shape and size.

Although not shown in FIG. 4, it is also contemplated that the hardfacing 41 may be deposited into a cavity or depression formed in the top surface 43 of the bit blade 44. The depression or cavity may comprise at least one groove to better affix the hardfacing 41, or to impart a desired residual stress state in the hardfacing 41.

Figure 5B:
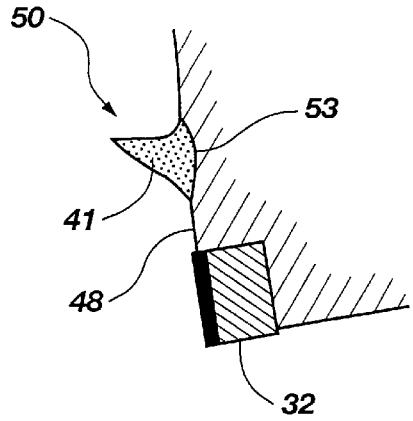
FIGS. 5A–5C depict side cross-sectional views of chip breakers with different geometries of the present invention.
Figure 5A:
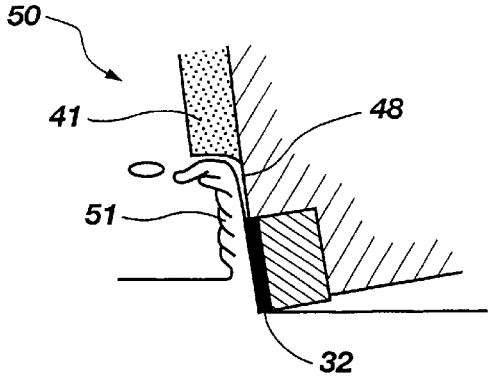
Figure 5C:
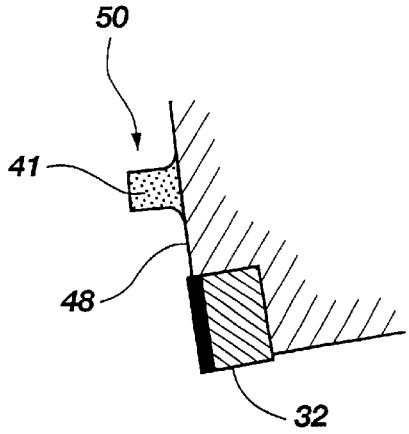

FIG. 5A depicts a cross-sectional view of a chip breaker 50 of the present invention in use where a continuous formation chip 51 is traveling along the front blade surface 48 until contacting the chip breaker 50 composed of hardfacing 41. The chip 51 is then deflected by the chip breaker 50, thus causing the continuous chip 51 to break. FIGS. 5B and 5C show different embodiments for chip breakers 50 formed from hardfacing 41. FIG. 5B shows hardfacing 41 which has been deposited into a slight depression 53 in the front blade surface 48 to form chip breaker 50. The hardfacing 41 may be machined, ground, or otherwise shaped subsequent to its deposit to achieve a desired geometry.

Figure 6A:
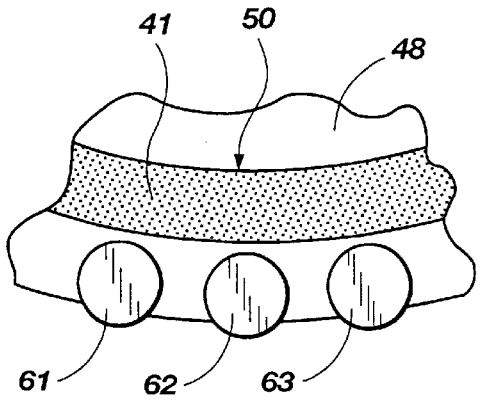
FIGS. 6A and 6B depict front elevations of bit blades with continuous and discrete chip breakers of the present invention, respectively.
Figure 6B:
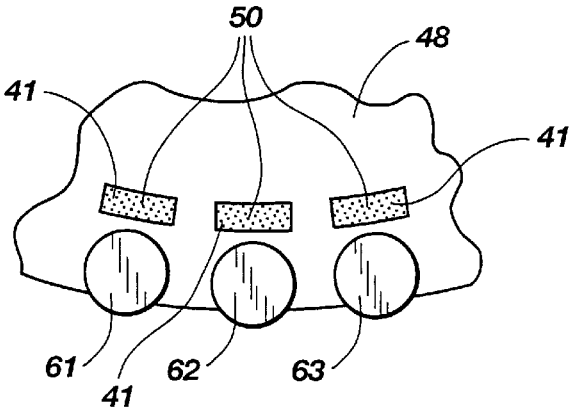

Also, chip breakers may be configured as discrete elements or continuous elements on the front blade surface 48, as depicted in FIGS. 6A and 6B. FIG. 6A shows a front view of a blade section including cutters 61, 62, and 63 as well as a continuous chip breaker 50 formed from hardfacing 41. The chip breaker 50 is shown as having a uniform cross-sectional area of hardfacing 41. However, the chip breaker 50 need not be formed to exhibit a uniform cross section. The cross section as shown in FIGS. 5A–5C may vary to improve the performance of the chip breaker 50. For instance, it may be advantageous to impart a twisting component to the chip 51 as it moves across the front blade surface 48, or the chip breaker 50 cross-sectional geometry may be tailored to back rake or side rake angles of the cutters, as known by those of ordinary skill in the art. FIG. 6B shows an example of discrete chip breakers 50 formed from hardfacing 41 and generally aligned with cutters 61, 62, and 63. These discrete chip breakers 50 may or may not have similar cross-sectional geometries. As shown in FIG. 5B, the chip breaker 50 may be formed in a depression or groove 53 which may be designed to impart favorable residual stress to the deposited hardfacing 41. Additionally, such increased surface area may improve the bonding of the hardfacing 41 to the front blade surface 48.

Figure 7:
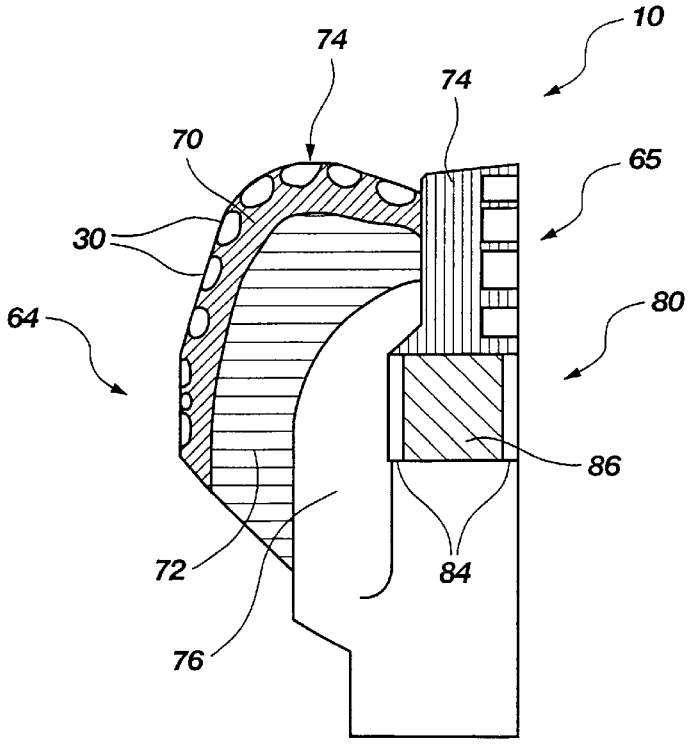
FIG. 7 depicts a side elevation of a partial steel body bit of the present invention with multiple hardfacing compositions thereon.

FIG. 7 shows a side elevation of a partial steel body drill bit 10 of the present invention. Two bit blades 64 and 65 are configured with multiple hardfacing compositions. A first hardfacing 70 is deposited over the outermost section of the bit blade 64 from the bit body 76 and is depicted by diagonal cross-hatching. A second hardfacing 72, represented by horizontal cross-hatching, is deposited on the front surface of blade 64. A third hardfacing 74 is deposited on the top surfaces of blades 64 and 65, as shown by the vertically hatched region of blade 65. The remaining bit body 76 area may be hardfaced with yet another hardfacing if desired. Thus, one possible embodiment for the application of multiple hardfacing compositions is shown in FIG. 7.

Although the depictions of multiple hardfacing compositions on steel body drill bits are shown as adjacent areas of hardfacing, this is not intended to limit the present invention. Different hardfacing compositions may overlap or be layered to form any of the aforementioned structures, coatings, or gage elements. It is contemplated that hardfacing layers of similar or differing composition may be added in critical areas of the bit, or omitted in noncritical areas of the bit. Hardfacing layers may be machined or ground after application before additional layers are deposited. Additionally, one or more grooves may be placed in a hardfacing layer in preparation for a subsequently applied hardfacing layer.

The configuration of multiple hardfacing compositions may be determined by a number of different criteria. Hydraulic, abrasion and erosion measurements and simulations may be used to identify relative amounts of erosion and abrasion on a steel body bit surface. The volume of rock cuttings generated at different positions along the bit may be considered as well as hydraulic flow characteristics. However, other considerations may influence the erosion of different areas of the bit. For instance, the stress state of the hardfacing material may influence the resistance of the hardfacing material to erosion. In addition, the stress state of the subterranean formation adjacent the borehole may affect chip formation and behavior. Dilatation, the volume change of rock as it is exposed to confining pressure, may affect chip formation and erosive behavior on the bit body. Therefore, hardfacing compositions may be arranged to compensate for predicted or measured erosive wear on the steel body drill bit 10.

In addition to that described above, FIG. 7 also shows a gage pad 80 according to the present invention. Gage pad 80 is surfaced by a first hardfacing 84 deposited on the rotationally leading and trailing edges thereof. A second hardfacing 86 is deposited to form the gage pad surface between the leading and trailing edges. It is contemplated that the first hardfacing 84 is formulated to exhibit toughness, and the second hardfacing 86 is formulated to exhibit erosion and abrasion resistance. Thus, the first hardfacing 84 resists fracturing at the leading and trailing edges and the second hardfacing 86 resists the erosive and abrasive wear present as the bit rotates against the borehole sidewall during drilling conditions.

Figure 8:
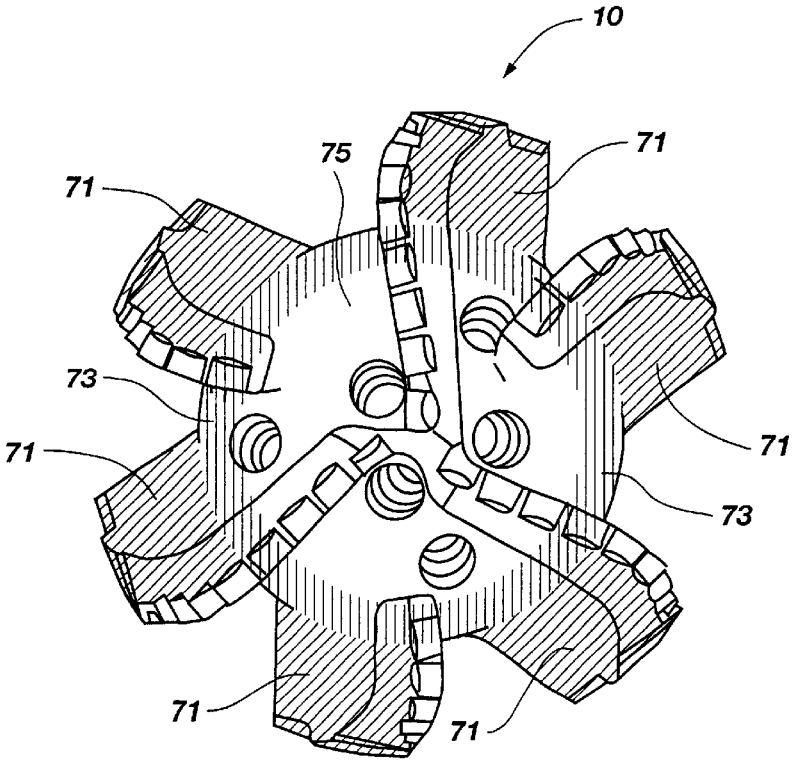
FIG. 8 depicts a top elevation of a steel body bit of the present invention with multiple hardfacing compositions thereon.

FIG. 8 depicts a top elevation of a steel body drill bit showing an alternate configuration for multiple hardfacing compositions, wherein hardfacings 71, 73, and 75 are deposited with respect to different radial areas of the steel body drill bit 10. The outer radial area of the steel body drill bit 10 carries a first hardfacing 71, as depicted by diagonal hatching. A second hardfacing 73, as depicted by vertical hatching, covers a radial area in between the first hardfacing 71 and a third hardfacing 75. The radial area from the center of the steel body drill bit 10 to the second hardfacing 73 carries the third hardfacing 75. Although the areas depicted in FIG. 8 are not overlapping, the present invention provides for such. Regions of differing hardfacing composition may overlap, abut, or otherwise interact. Alternatively, regions of differing hardfacing composition need not be contiguous whatsoever.

Figure 9A:
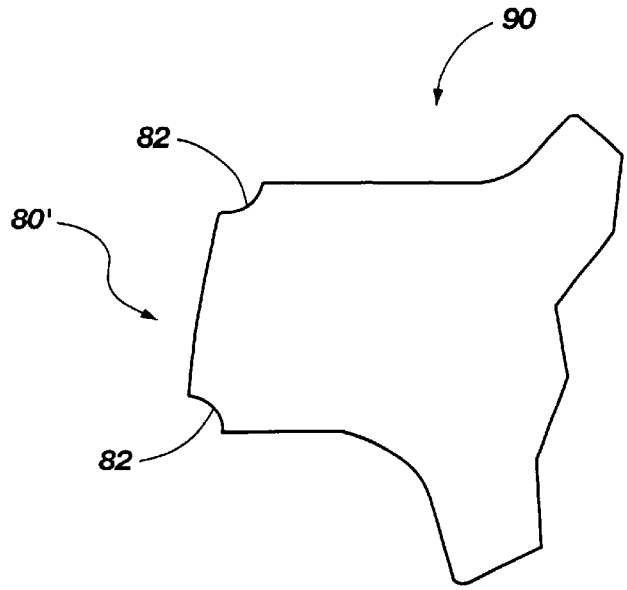
FIGS. 9A–9E respectively depict a top cross-sectional view of a gage pad of the present invention configured with alternate groove embodiments.
Figure 9B:
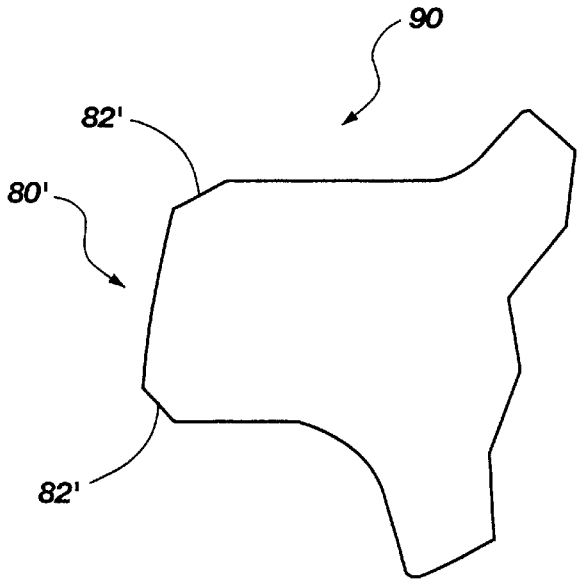
Figure 9C:
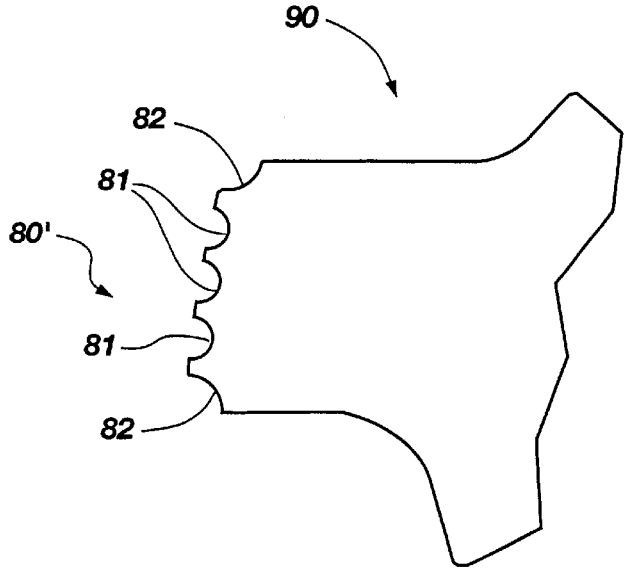

FIG. 9A depicts a cross-sectional view of a gage section 90 of a bit blade. Surface 80' shows where a gage pad 80 (FIGS. 7, 10A and 10B) will be surfaced by application of hardfacing. Grooves 82 are formed in the leading and trailing edges of the gage section 90 in preparation for application of one or more hardfacing compositions. The grooves depicted in FIG. 9A are shown as having a radial cross section. In the alternative, the grooves may be formed as a chamfer 82' as shown in FIG. 9B or have an otherwise desirable cross section. As shown in FIG. 9C, multiple grooves 81 may be placed into the surface 80' prior to hardfacing. Any of the above-mentioned grooves 81, 82 or chamfers 82' may be formed by machining, grinding, or broaching, or they may be integrally formed with the bit body.

It is noted that the groove geometry shown in FIGS. 9A through 9E is simply illustrative and should not be considered as limiting in any sense. Rather, various groove shapes and patterns may be used according to the present invention. By way of example, V-shaped grooves, concentric grooves, or various groove or other cross-sectional geometries may be utilized. It is similarly noted that various groove depths, groove paths, groove spacing, groove orientations, overlapping configurations or combinations of various geometrical parameters may be utilized. Likewise, features of the various configurations depicted in FIGS. 9A–9E may be combined in alternative arrangements.

Figure 9D:
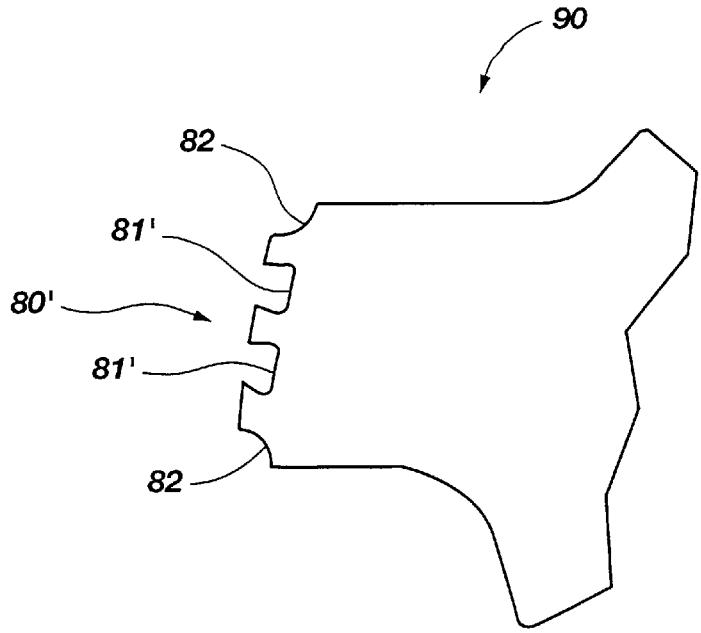

FIG. 9D shows an example of such a possible alternative cross-sectional geometry. The grooves 81' are formed such that they are undercut. In other words, the base of each groove 81' is wider, or larger in cross-sectional area, than is its associated opening at the gage surface 80'. Such a geometry advantageously allows a subsequently applied hardfacing material, to mechanically interlock with the gage pad surface 80', thus combining with the metallurgical connection existing between the two materials for superior adherence of the hardfacing material to the gage pad surface 80'.

Figure 9E:
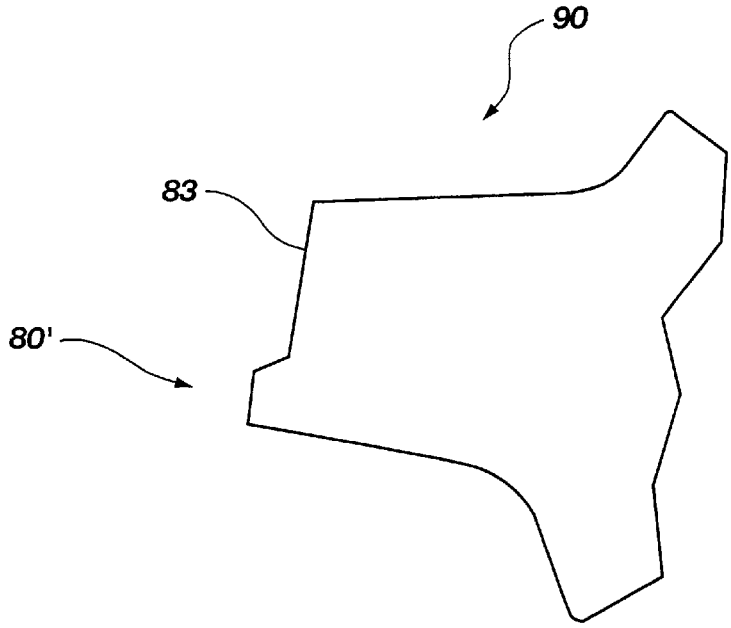

Another alternative geometry is shown in FIG. 9E. The groove 83 in this embodiment has been extended across a significant portion of the gage pad surface 80', allowing for an enlarged hardfacing structure to be formed. It is contemplated that the enlarged groove 83 may be formed to encompass either the leading or the trailing edge of the gage section 90. The composition of the applied hardfacing material may be properly selected depending, in part, on which edge of the gage section 90 the groove 83 encompasses.

Figure 10A:
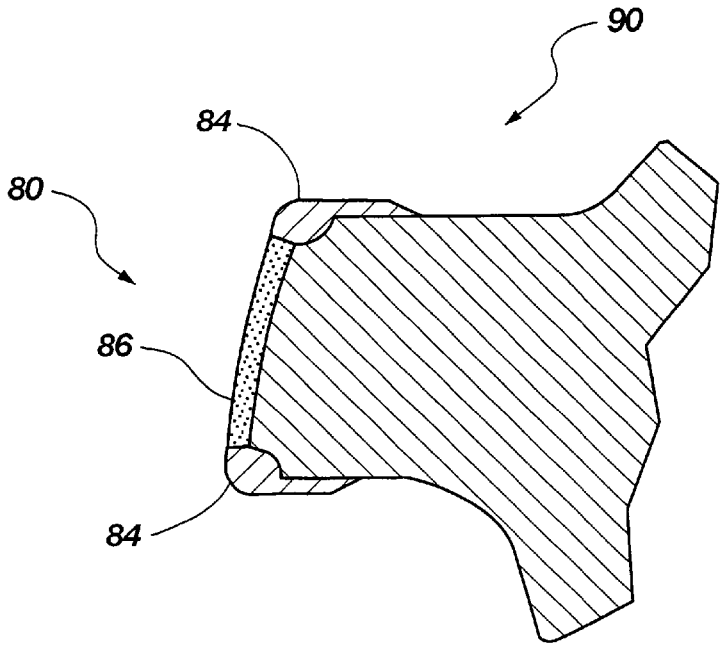
FIGS. 10A and 10B respectively depict a top cross-sectional view of a gage pad of the present invention comprised of two hardfacing compositions.

FIG. 10A depicts the cross-sectional view of FIG. 9A with the addition of a first hardfacing 84 deposited substantially into grooves 82 on the rotationally leading and trailing edges of the gage and also partially extending along both the leading and trailing edges of the gage section 90 of the bit blade beyond the grooves 82. This first hardfacing may advantageously be a composition such as, for example, a composition with the majority of the deposit containing sintered tungsten carbide for increased toughness and fracture resistance in these locales. A second hardfacing 86 is deposited substantially between the first hardfacing 84. The second hardfacing 86 may be a composition which advantageously resists sliding wear and abrasion such as, for example, a lower percent of sintered tungsten carbide with a higher percent of cast carbide. Another example may be macrocrystalline tungsten carbide.

Figure 10B:
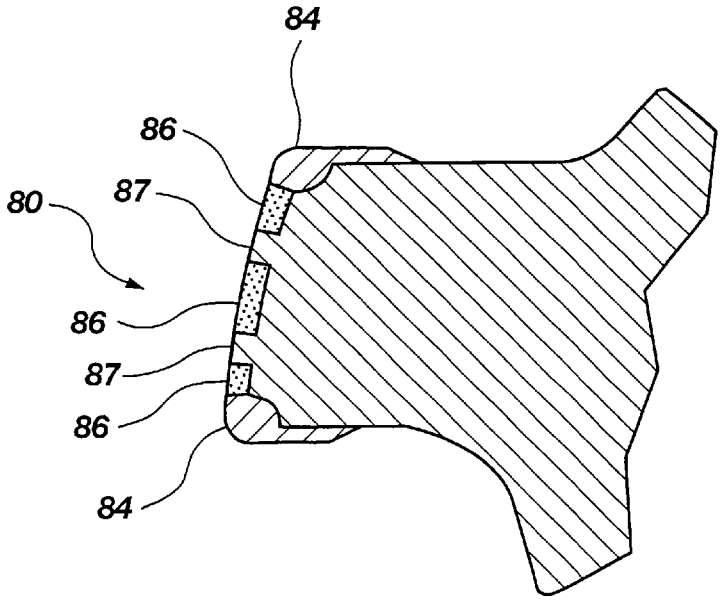

Although in FIG. 10A the first hardfacing 84 and second hardfacing 86 substantially cover the surface 80' after formation of the gage pad 80, other embodiments are contemplated. For instance, FIG. 10B shows such an embodiment, where the hardfacing 86 does not completely encompass the surface 80'. Such a configuration may be achieved by hardfacing the preformed grooves 82, or by hardfacing the entire surface 80' and then partially exposing steel surfaces 87 by machining or grinding to create the gage 80. Again, this may be advantageous to modify residual stresses in the hardfacing. Alternatively, sintered carbide may be placed onto steel surfaces 87 and "welded" into place by hardfacing for increased erosion and abrasion resistance, or otherwise attached as known in the art. Similar hardfacing configurations may be implemented with the various gage sections 90 disclosed in FIGS. 9A–9E as well as with noted alternative cross-sectional geometries.

Figure 11A:
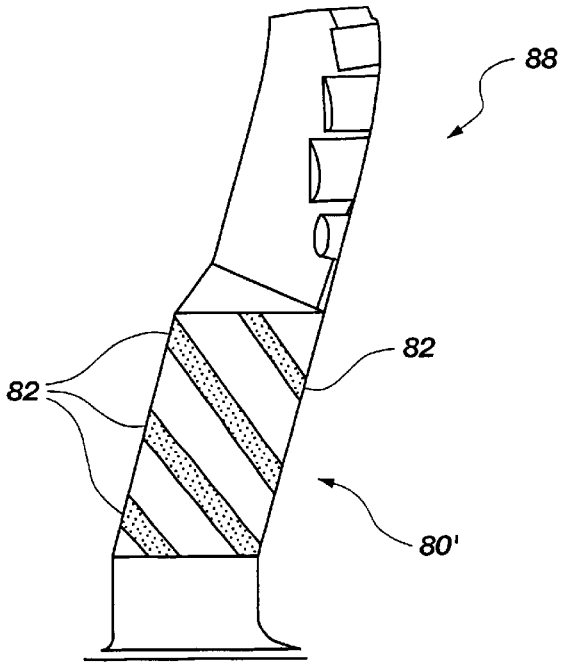
FIGS. 11A–11C respectively depict side elevations of steel body bit blades of the present invention with alternate groove configurations.
Figure 11B:
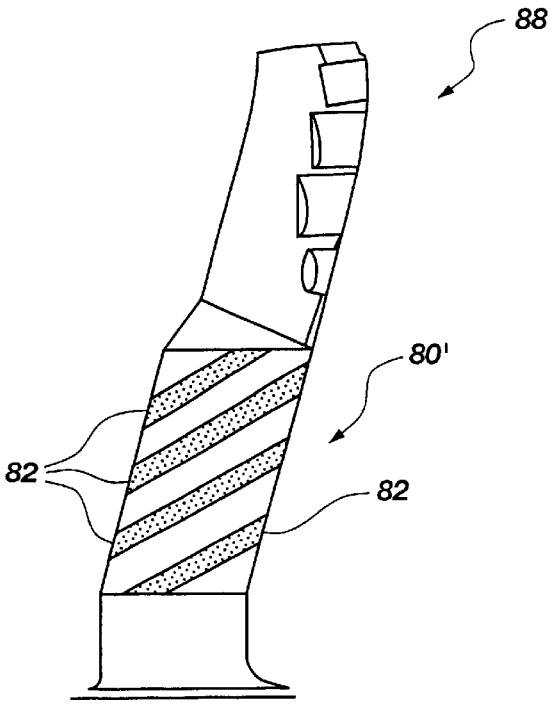
Figure 11C:
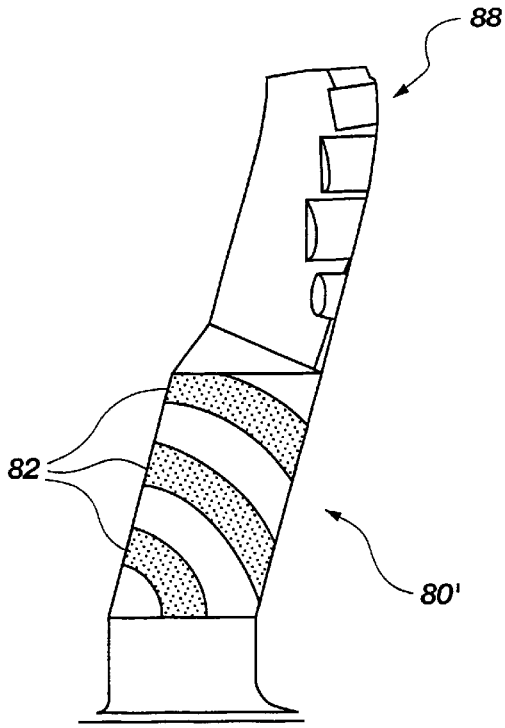

In an alternative embodiment, it may be desirable to orient the hardfacing according to expected loads or contemplated stress experienced by the bit 10 during operation. For example, since a gage pad 80 on a rotating drill bit 10 during operation is traveling in a downwardly extending shallow helix, it may be advantageous to orient or align grooves with respect to a helix angle, or range of angles corresponding to a range of rates of penetration, such that loading experienced by the hardfacing during drilling is better supported with regard to its interaction with the encountered formation. FIGS. 11A–11C depict side elevations of steel body bit blades 88 with steel surfaces 80' in the gage sections of the bit blade 88. Each of these steel surfaces 80' depicted in FIGS. 11A–11C has a series of grooves 82 in various orientations. FIG. 11A depicts grooves 82 which are generally perpendicular to the helix angle. FIG. 11B depicts grooves 82 which are generally parallel to the helix angle. The helix angle may be varied according to the expected rate of penetration and rotational speed such that the grooves will be oriented at an expected average value of helix angle, depending on the intended limits of the operational parameters of the bit. FIG. 11C depicts concentric grooves 82, which may provide additional advantages with regard to external loading as well as residual stress considerations.

The above-disclosed embodiments further lend themselves to complementary methods of making a steel body drill bit as well as methods for designing such a drill bit. For example, a method of designing a drill bit might include selecting an existing drill bit and subjecting the drill bit to one or more tests, such as placing the bit in an actual or simulated drilling environment. As the drill bit is subjected to testing, data may be collected regarding the results of such testing. The collected data may then be utilized to design a hardfacing configuration including, for example, the size, shape, location, and stress state of the hardfacing configuration to be employed. Furthermore, the type of hardfacing material to be used may be determined according to the material characteristics required for the desired hardfacing configuration. Various engineering tools known to those of ordinary skill in the art may be employed to assist in the design. Such tools may include, for example, mathematical modeling, computational fluid dynamics, finite element analysis, and CAD solid modeling.

It is noted that the application of hardfacing to the bit 10 in any of the above-described embodiments may be accomplished by more than one process. For example, it is contemplated that hardfacing be applied through an oxyacetylene welding process (OXY). However, other processes may be employed such as, for example, atomic hydrogen welding (ATW), welding via tungsten inert gas (TIG), gas tungsten arc welding (GTAW) or other applicable processes as known by one of ordinary skill in the art.

In summary, the present invention provides rotary drag-type drill bits having substantially protruding structural elements, such as, for example, wear knots or chip breakers, to be formed onto a steel body bit from hardfacing. The present invention also provides for coatings and gage sections which are composed of at least two different hardfacing compositions and may be configured and located according to material characteristics and expected loading and wear patterns experienced by the bit. Additionally, the present invention provides methods for making and designing such bits.

While the invention may be susceptible to various modifications and alternative forms, specific embodiments have been shown by way of example in the drawings and have been described in detail herein. However, it should be understood that the invention is to cover all modifications, equivalents, and alternatives falling within the spirit and scope of the invention as defined by the following appended claims.

What is claimed is:

1. A rotary steel body drag bit for drilling a subterranean formation, comprising:

a bit body having a longitudinal axis and including a bit face at a leading end thereof and structure for connecting the rotary drag bit to a drill string at a trailing end thereof;

a plurality of cutters located over the bit face, at least one of the plurality of cutters comprising a superabrasive cutting face including a cutting edge located to engage the subterranean formation; and at least one discrete structural element on the bit body comprising a weldment comprising at least one hardfacing composition disposed on the bit body as a three-dimensional protrusion defined by a consolidated mass of material secured to an underlying surface of the bit body in non-conformal relationship thereto.

2. The steel body drag bit of claim 1, wherein the at least one discrete structural element comprises a wear knot.

3. The steel body drag bit of claim 1, wherein the at least one discrete structural element comprises a chip breaker.

4. The steel body drag bit of claim 1, wherein the weldment extends at least partially into at least one groove on the bit body.

5. The steel body drag bit of claim 1, wherein the at least one hardfacing composition includes a first abrasion-resistant hardfacing composition and a second fracture-resistant hardfacing composition.

6. The steel body drag bit of claim 1, wherein the at least one hardfacing composition includes macrocrystalline tungsten carbide.

7. The steel body drag bit of claim 1, wherein the at least one hardfacing composition includes at least one of spherical sintered tungsten carbide, crushed sintered tungsten carbide and cast tungsten carbide.

8. The steel body drag bit of claim 1, wherein the at least one discrete structural element comprising a weldment including at least one hardfacing composition is formed of multiple layers of the at least one hardfacing composition.

9. The steel body drag bit of claim 8, wherein at least one of the multiple layers exhibits a machined surface.

10. The steel body drag bit of claim 8, wherein at least one of the multiple layers exhibits a ground surface.

11. The steel body drag bit of claim 8, wherein the multiple layers include at least two different hardfacing compositions.

12. A rotary steel body drag bit for drilling a subterranean formation, comprising:

a bit body having a longitudinal axis and including a bit face at a leading end thereof and structure for connecting the rotary drag bit to a drill string at a trailing end thereof;

a plurality of cutters located on the bit face, at least one of the plurality of cutters comprising a superabrasive cutting face including a cutting edge located to engage the subterranean formation; and at least two different hardfacing compositions welded on an external surface of the bit body.

13. The steel body drag bit of claim 12, wherein the external surface comprises a gage pad formed on the bit body.

14. The steel body drag bit of claim 13, wherein the gage pad is configured to include a rotationally leading edge and a rotationally trailing edge and wherein one of the at least two hardfacing compositions is located on at least one of the rotationally leading and trailing edges.

15. The steel body drag bit of claim 14, wherein another one of the at least two hardfacing compositions is located on the gage pad between the rotationally leading and trailing edges.

16. The steel body drag bit of claim 12, wherein the external surface comprises a bit blade formed on the bit face.

17. The steel body drag bit of claim 12, wherein the external surface comprises the bit face.

18. The steel body drag bit of claim 12, wherein the external surface includes at least one groove wherein at least one hardfacing of the at least two different hardfacing compositions is disposed in and substantially fills the at least one groove.

19. The steel body drag bit of claim 18, wherein the at least one groove is oriented on the bit according to a predetermined loading to be experienced by the bit.

20. The steel body drag bit of claim 18, wherein the at least one groove is oriented on the bit according to a pretermined high stress area in the at least one hardfacing disposed in the at least one groove.

21. The steel body drag bit of claim 12, wherein the at least two different hardfacing composition are substantially contiguous.

22. The steel body drag bit of claim 12, wherein one of the at least two different hardfacing composition overlaps at least another hardfacing composition.

* * * * *